US008915102B2

(12) United States Patent
Moon et al.

(10) Patent No.: US 8,915,102 B2
(45) Date of Patent: Dec. 23, 2014

(54) CLOTHES TREATING APPARATUS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Kwang Hee Lee, Changwon-si (KR); Hye Yong Park, Changwon-si (KE); Chang Gyu Choi, Changwon-si (KE)

(73) Assignee: LG Electronics Inc., Seoul (KR)

( * ) Notice: Subject to any disclaimer, the term of this patent is extended or adjusted under 35 U.S.C. 154(b) by 1059 days.

(21) Appl. No.: 12/733,020

(22) PCT Filed: Aug. 4, 2008

(86) PCT No.: PCT/KR2008/004517

§ 371 (c)(1),
(2), (4) Date: Apr. 14, 2010

(87) PCT Pub. No.: WO2009/020324

PCT Pub. Date: Feb. 12, 2009

(65) Prior Publication Data

US 2010/0218566 A1 Sep. 2, 2010

(30) Foreign Application Priority Data

Aug. 3, 2007 (KR) ..... 10-2007-0078290
Mar. 28, 2008 (KR) ..... 10-2008-0027827

(51) Int. Cl.
*B08B 3/12* (2006.01)
*D06F 58/10* (2006.01)
*D06F 58/20* (2006.01)

(52) U.S. Cl.
CPC ..... *D06F 58/10* (2013.01); *D06F 58/203* (2013.01)
USPC ..... 68/5 C; 68/6; 68/205 R; 68/5 R; 134/94.1; 8/149.3; 38/1 A; 38/14; 38/3

(58) Field of Classification Search
CPC ..... D06F 73/02; D06F 58/10; D06F 58/203; D06F 17/04; D06F 18/00
USPC ..... 68/5 C, 6; 134/113; 8/137, 142, 149.2, 8/149.3; 34/32, 202, 210; 211/123
See application file for complete search history.

(56) References Cited

U.S. PATENT DOCUMENTS

| | | | | |
|---|---|---|---|---|
| 3,672,188 | A * | 6/1972 | Geschka et al. | 68/12.15 |
| 3,805,561 | A | 4/1974 | Bullock | |
| 5,094,020 | A | 3/1992 | Wingfield et al. | |
| 5,305,484 | A * | 4/1994 | Fitzpatrick et al. | 8/149.3 |
| 7,669,519 | B2 * | 3/2010 | Pope et al. | 99/315 |
| 2001/0037590 | A1 * | 11/2001 | MacGregor et al. | 38/3 |
| 2004/0063319 | A1 * | 4/2004 | Toshima et al. | 438/689 |
| 2005/0223502 | A1 | 10/2005 | Kleker | |
| 2010/0018072 | A1 * | 1/2010 | Kim et al. | 34/86 |

FOREIGN PATENT DOCUMENTS

| | | | |
|---|---|---|---|
| EP | 0 324 589 | A1 | 7/1989 |
| EP | 3 324 589 | A1 | 7/1989 |
| JP | 05-161797 | | 6/1993 |
| JP | 10-080331 | | 3/1998 |
| KR | 10-0587360 | | 5/2006 |
| KR | 10-2009-0050620 | A | 5/2009 |
| KR | 10-2009-0014051 | A | 6/2009 |
| WO | WO 2006/031136 | A1 | 3/2006 |
| WO | WO 2006/091057 | A1 | 8/2006 |

* cited by examiner

*Primary Examiner* — Michael Barr
*Assistant Examiner* — Thomas Bucci
(74) *Attorney, Agent, or Firm* — McKenna Long & Aldridge LLP

(57) ABSTRACT

A clothes-treating apparatus is disclosed. According to the present invention, the clothes-treating apparatus includes a steam spraying unit capable of preventing water condensed from steam from flowing into an accommodating space containing clothes and it has an improved steam spraying unit to enhance work efficiency when a worker assembles parts thereof.

16 Claims, 7 Drawing Sheets

CLOTHES TREATING APPARATUS

This application is a National Stage Entry of International Application No. PCT/KR2008/004517, filed on Aug. 4, 2008, and claims priority to Korean Patent Application No. 10-2007-0078290, filed Aug. 3, 2007, and Korean Patent Application No. 10-2008-0027827, filed Mar. 26, 2008, each of which is hereby incorporated by reference in its entirety as if fully set forth herein.

TECHNICAL FIELD

The present invention relates to a clothes-treating apparatus and a controlling method thereof. More particularly, the present invention relates to a clothes-treating apparatus which includes a steam spraying unit capable of preventing water condensed from steam from flowing into an accommodating space containing clothes and which has an improved steam spraying unit to enhance work efficiency when a worker assembles parts thereof.

BACKGROUND ART

A clothes-treating apparatus refers to an apparatus which treats clothes placed in an accommodating space provided in a cabinet. Here, the term 'treat' means predetermined processes, for example, ventilating air to the clothes, supplying steam or hot air to the clothes to remove bad smell, wrinkles and humidity that remain on the clothes. As a result, a user can feel pleasant when putting on the clothes.

Specifically, when putting on a piece of clothes more than once, unpleasant smell, humidity and the like may remain on the clothes and this may give an unpleasant feeling to a user who tries to put on the piece again. To remove them, the piece might be washed but the quite often washing of the clothes happens to lead to short usage life of the clothes as well as the high cost required to maintain the cleaning of the clothes.

In addition, even after washing and drying the clothes, wrinkles may remain. It is inconvenient of the user to perform additional chores like ironing and variations of it and not to put on the clothes immediately.

To solve these problems, a clothes-treating apparatus may be used to remove unpleasant smell, wrinkles and humidity which remain on clothes.

According to the clothes-treating apparatus, moisture is supplied to clothes placed in an accommodating space to remove the unpleasant smell, wrinkles and humidity and air, including dry and hot air, is supplied to the clothes having much moisture because of sprayed steam to dry the clothes.

It may be effective only to expose the clothes to air or hot air when removing the unpleasant smell, wrinkles and humidity. The moisture may be supplied to the clothes to enhance the effect of the removal noticeably.

If moisture is supplied to the clothes placed in the clothes-treating apparatus, minute water elements are united with unpleasant smell elements remaining on fabric texture of the clothes and then the water elements united with the smell elements may separate from the clothes during a drying process, only to be discharged outside. In such the process, the unpleasant smell remaining on the clothes may be removed.

According to the above process, unpleasant smell, wrinkles and humidity remaining on the clothes may be removed and the user may put on the clothes with a pleasant feeling.

DISCLOSURE OF INVENTION

Technical Problem

According to the conventional clothes-treating apparatus, water condensed from steam might be exhausted from a steam spraying unit (or a spray nozzle) spraying steam to an accommodating space containing clothes. As mentioned above, the reason why steam is supplied to the clothes in the clothes-treating apparatus is to remove bad smell or wrinkles remaining on the clothes. However, if water, not steam, is exhausted from the steam spraying unit, a drying process may be interfered with which will be performed after the steam supplying and user satisfaction may deteriorate.

In addition, it is typical that the clothes-treating apparatus is configured of a cabinet type having an accommodating space. The accommodating space containing clothes is formed in an upper portion of the cabinet and a mechanism compartment containing a moisture supply device and an air supply device is positioned under the accommodating space. The accommodating space and the mechanism compartment are separated by a partition partitioning off the two spaces.

Such the moisture supply part may include a moisture supply part supplying moisture to the clothes. At this time, the clothes may be treated effectively by the moisture supplied to the clothes. However, it is not preferable that water is sprayed into the accommodating space and a moisture supply easy to assemble capable of supplying moisture to the clothes uniformly with each assembly structure is required.

TECHNICAL SOLUTION

To solve the problems, an object of the present invention is to provide a clothes-treating apparatus which includes a steam spraying unit capable of preventing water condensed from steam from flowing into an accommodating space containing clothes and which has an improved steam spraying unit to enhance work efficiency when a worker assembles parts thereof.

To achieve this object and other advantages and in accordance with the purpose of the invention, as embodied and broadly described herein, a clothes treating apparatus includes a cabinet having an accommodating space where clothes are placed; a moisture supply device generating steam to be supplied to the accommodating space; and a steam spraying unit comprising a single steam supply hole supplying the steam generated by the moisture supply device and a plurality of steam spray holes spraying the steam.

The steam spraying unit may have a main pipe having the steam supply hole and a plurality of sub-pipes extended from the main pipe.

A flow direction of the steam inside the main pipe may be different from a flow direction of the steam inside the sub-pipe.

The flow direction of the steam inside the main pipe may be orthogonal to the flow direction of the steam inside the sub-pipe.

The steam may be supplied by the main pipe in a horizontal direction and the steam is sprayed in an upward direction by the sub-pipe.

A flow direction of the steam sprayed from the steam spraying unit may be different from a flow direction of water condensed inside the steam spraying unit.

Water condensed from the steam inside the main pipe may be collected in a lower portion of the main pipe and the steam supplied by the steam supply hole may be flowing in an upper portion of the main pipe.

The condensed water collected in the main pipe may be drained through a condensed water exhaustion hole formed at the main pipe.

The main pipe may be oblique for the condensed water exhaustion hole to face downward.

The condensed water exhausted via the condensed water exhaustion hole may be drained to a water collection part containing water temporarily before being drained outside.

The steam spraying unit may be positioned in a lower portion of the accommodating space and mounted in an upper portion of a mechanism compartment partitioned from the accommodating space by a partition.

The clothes treating apparatus may further include a steam spray nozzle fastened to the sub-pipe, passing through the partition partitioning off the accommodating space and the mechanism compartment, to supply steam to the accommodating space.

The steam spray nozzle may include a plurality of spray holes.

An upper surface of the steam spray nozzle may have a convex curvature.

Either of the sub-pipe and a predetermined portion of the steam spray nozzle may be inserted in the other, the predetermined portion being fastened to the sub-pipe through the partition.

A screw thread may be firmed at an inner surface of the sub-pipe and an outer surface of the portion of the steam spray nozzle fastened to the sub-pipe through the partition, to screw-fasten the steam spray nozzle to the steam spraying unit, with the partition being provided between the steam spray nozzle and the steam spraying unit.

The steam spraying unit may be mounted to a supporting frame provided in the mechanism compartment to support the steam spraying unit.

A plurality of projections may be formed at a lower surface of the steam spraying unit and a plurality of grooves corresponding to the projections may be formed at an upper surface of the supporting frame, and the projection may be fixedly inserted in the corresponding groove.

If the projections are inserted in the grooves, the height of the steam spraying unit may be substantially lower than the height of the steam spraying unit when the steam spray nozzle is fastened to the sub-pipe.

A bottom of the mechanism compartment may be separable from the mechanism compartment and if the bottom of the mechanism compartment is separated outside the cabinet, the steam spraying unit may be separated outside the cabinet in a state of being mounted to the supporting frame.

The clothes treating apparatus may further include an air supply device dehumidifying or heating air inside the accommodating space.

The air supply device includes a heat pump including a compressor compressing refrigerant, and a heat exchanger heat-exchanging the refrigerant with the air inside the accommodating space.

ADVANTAGEOUS EFFECTS

The present invention has following advantageous effects.

According to the clothes-treating apparatus, steam is sprayed to the clothes contained in the accommodating space and hot or dry air is used to dry the clothes containing moisture because of the sprayed steam. As a result, bad smell, wrinkles and humidity remaining on the clothes may be removed only to improve user satisfaction.

Furthermore, according to the steam spraying unit of the clothes-treating apparatus, the water condensed from the steam supplied by the moisture supply device provided in the mechanism compartment may be prevented from being exhausted into the accommodating space and as a result drying efficiency may be enhanced.

A still further, the steam spraying unit of the clothes-treating apparatus is installed in the mechanism compartment and as a result it is possible for a worker to assemble the steam spraying unit efficiently and then work performance may be enhanced.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
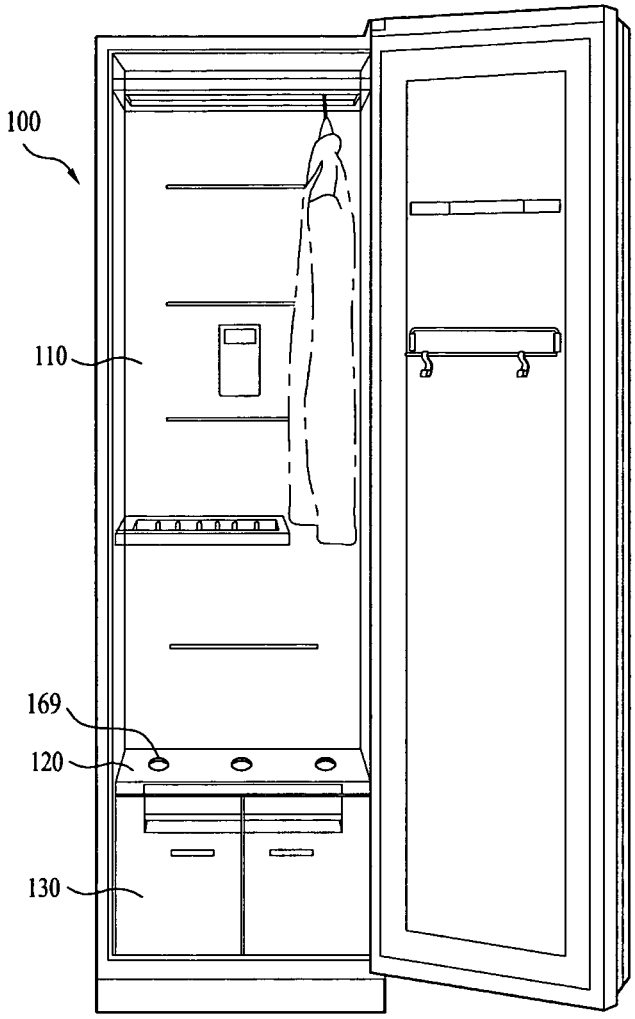
FIG. 1 is a front view illustrating a clothes-treating apparatus according to an exemplary embodiment.
Figure 2:
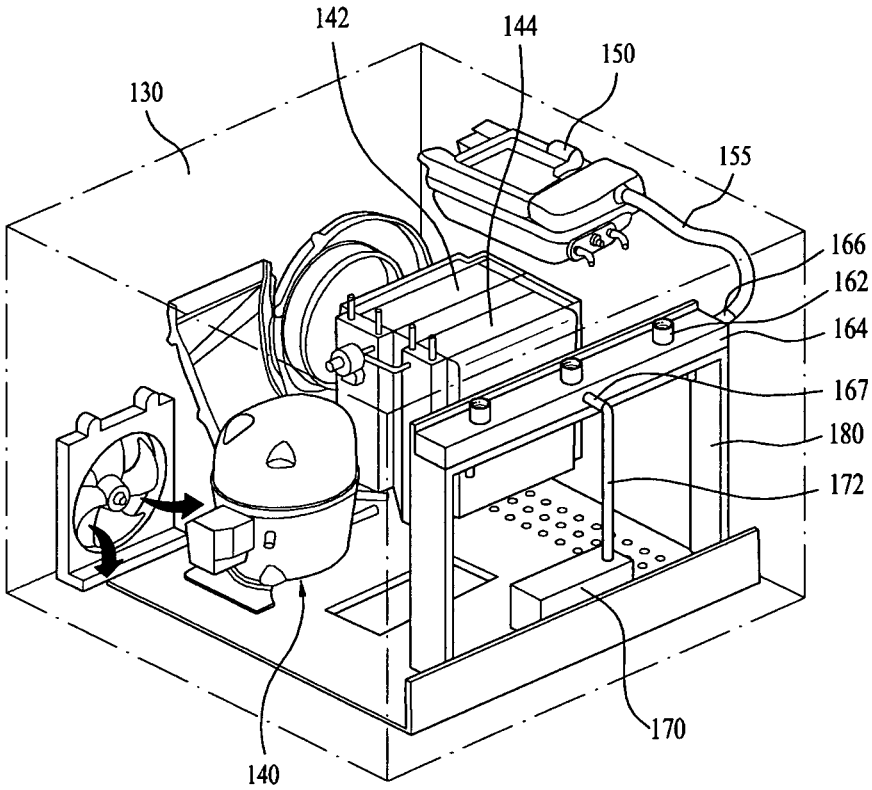
FIG. 2 is a diagram illustrating a mechanism compartment of the clothes-treating apparatus.
Figure 3:
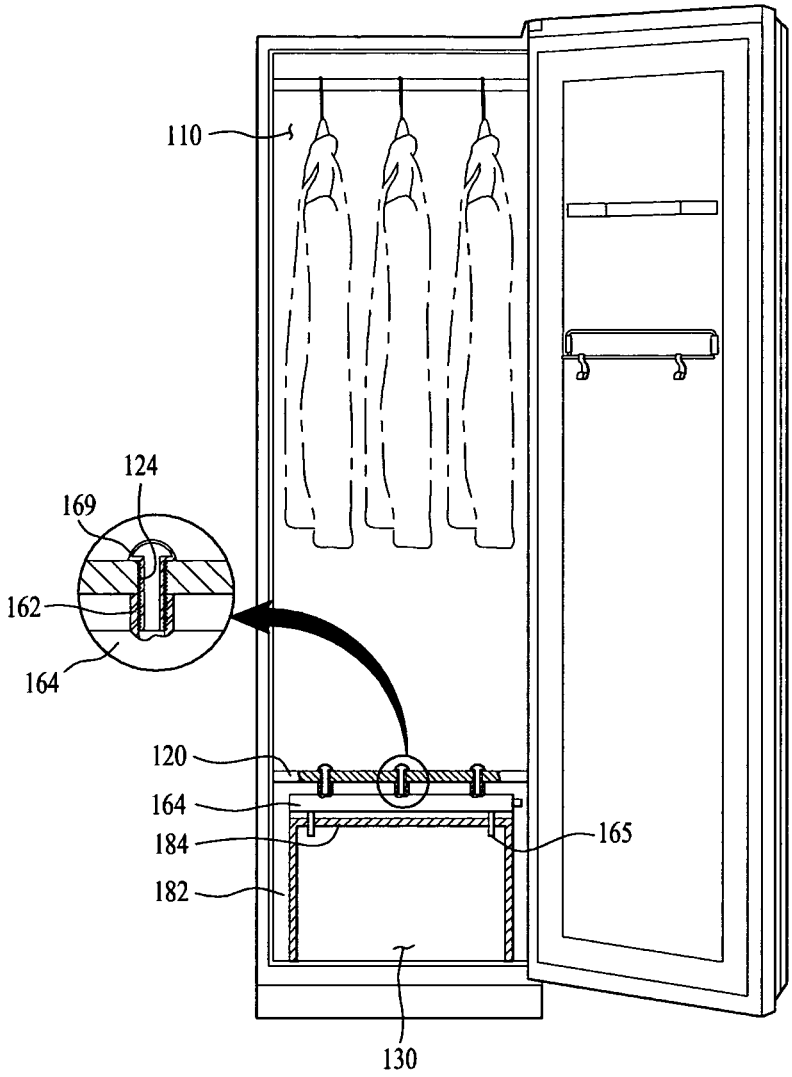
FIG. 3 is a diagram illustrating a steam spraying unit mounted in the clothes-treating apparatus.
Figure 4:
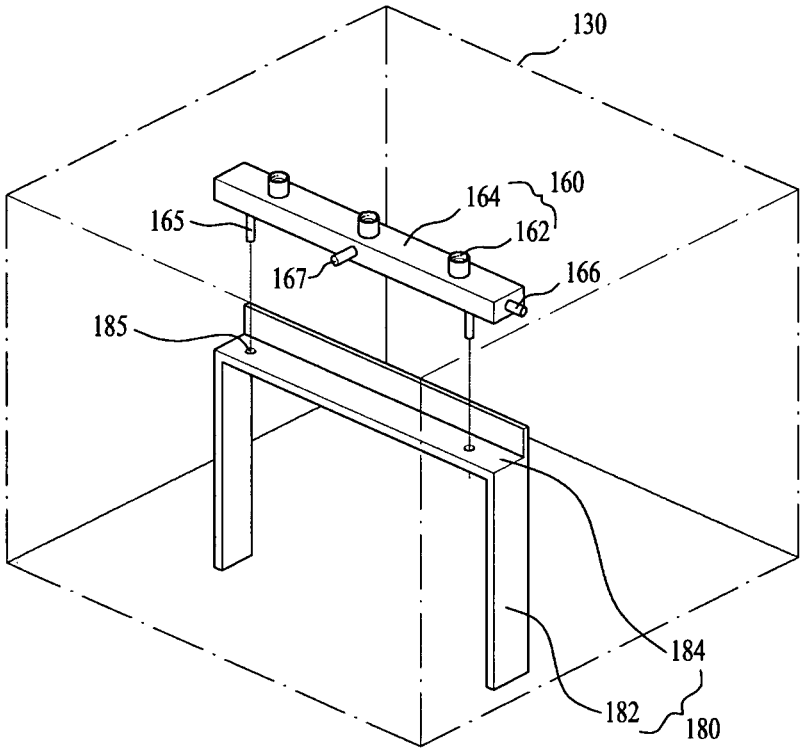
FIG. 4 is a perspective view illustrating the steam spraying unit before being mounted in the clothes-treating apparatus.
Figure 5:
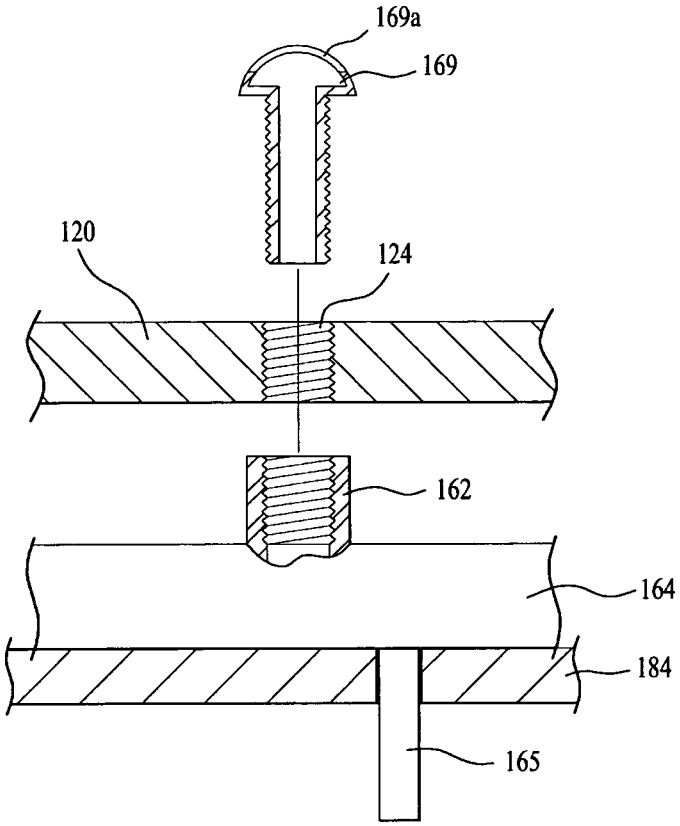
FIG. 5 is a sectional view illustrating a spray nozzle and a steam spraying unit before being connected with each other.
Figure 6:
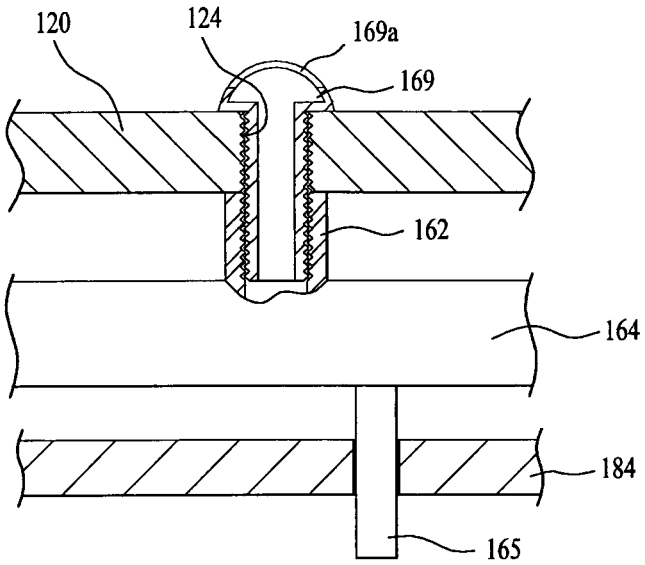
FIG. 6 is a sectional view illustrating the spray nozzle and the steam spraying unit after being connected.
Figure 7:
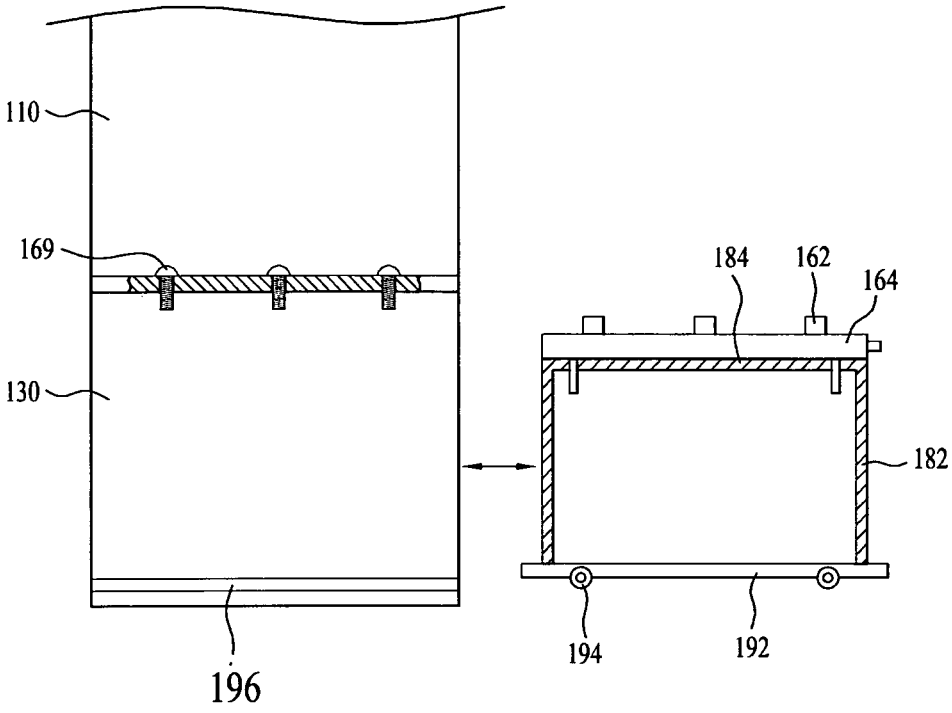
FIG. 7 is a diagram illustrating that the mechanism compartment including the steam spraying unit is separated from the clothes-treating apparatus.

FIG. 1 is a front view illustrating a clothes-treating apparatus according to an exemplary embodiment. FIG. 2 is a diagram illustrating a mechanism compartment of the clothes-treating apparatus. FIG. 3 is a diagram illustrating a steam spraying unit mounted in the clothes-treating apparatus. FIG. 4 is a perspective view illustrating the steam spraying unit before being mounted in the clothes-treating apparatus. FIG. 5 is a sectional view illustrating a spray nozzle and a steam supply part before being connected with each other. FIG. 6 is a sectional view illustrating the spray nozzle and the steam supply part after being connected. FIG. 7 is a diagram illustrating that the mechanism compartment including the steam spraying unit is separated from the clothes-treating apparatus.

In reference to FIGS. 1 and 2, the clothes-treating apparatus according to the exemplary embodiment includes a cabinet 100 defining an external appearance thereof and an accommodating space 110 formed in the cabinet 100 to hold clothes to be treated.

Under the accommodating space is provided a mechanism compartment 130 in which various components are mounted. Specifically, the mechanism compartment 130 includes a moisture supply device 150 supplying moisture to the accommodating space 110 and an air supply device supplying dry or heated air to the accommodating space 110.

The moisture supply device 150 is a device for supplying the moisture to the accommodating space as mentioned above and the supplied moisture may be steam. That is, if the moisture supplied to the clothes is steam, the moisture supply device may be a steam generator. However, the moisture supply device may be a device spraying water.

According to this embodiment shown in FIG. 2, the moisture supply device 150 is a steam generator. In this embodiment, the air supply device includes a heat pump. The heat pump is configured of a compressor 140 compressing refrigerant, an evaporator 144 evaporating the refrigerant and a condenser 142 condensing the refrigerant, in order to dehumidify and heat air.

Specifically, the refrigerant is evaporated in the evaporator 144 and latent heat of ambient air is absorbed. As a result, the air is cooled to condense and remove the moisture contained in the air. If the air is condensed at the condenser 142 via the compressor 140, the latent heat is exhausted toward the ambient air. As a result, the ambient air is heated.

At this time, the evaporator 144 and the condenser 142 are functioned as heat exchanger. The air drawn into the mechanism compartment 130 is dehumidified and heated via the evaporator 144 and the condenser 142 in order and then the dehumidified and heated air is re-supplied to the accommodating space 10.

This embodiment presents that the air supply device supplying dry or heated air to the accommodating space 10 is a heat pump and the air supply device is not limited thereto, for example, an electric heater may be applicable.

In the mechanism compartment 130 is provided a moisture supply device 150 supplying steam to the accommodating space 110. Wrinkles or bad smell which might remain on the clothes can be removed by the steam supplied to the accommodating space 110.

On the other hand, the clothes-treating apparatus according to this embodiment may include a steam spraying unit spraying the steam generated at the steam generator 150 to the accommodating space 110.

Next, in reference to FIGS. 2 to 6, the structure of the steam spraying unit will be described.

The steam spraying unit is detachably inserted in a bottom of the accommodating space 110, that is, a partition 120 to be connected with a plurality of steam spray nozzles 169 through which steam is sprayed to the accommodating space 110.

The appearance of the steam spray nozzle 169 may be variable and it is preferable that the appearance of the steam spray nozzle 169 is hemisphere or convex.

A plurality of spray holes 169*a* may be formed at ends of the steam spray nozzles 169, respectively, such that the steam supplied by the steam spraying unit 160 is sprayed to the accommodating space 110 via the spray holes 169*a*.

The steam spray nozzle 169 may be separably inserted through a through hole 124 formed at the bottom of the accommodating space 110, that is, the partition 120. the through hole 124 may be formed at the partition 120 in plural such that the plural steam spray nozzles 169 may be secured to a lower surface of partition 120 where the steam spray nozzles are inserted, specifically, to a sub-pipe of the steam spraying unit mounted in an upper portion of the mechanism compartment 130, which will be described later.

Either of a pillar portion of the steam spray nozzle 169 passing through the through hole 124 and the sub-pipe is inserted in the other one.

At this time, a screw thread may be formed at both the steam spray nozzle 169 and the sub-pipe such that the steam spray nozzle 169 may be connected with the sub-pipe, which will be described later, without auxiliary securing members.

The screw treads formed at the pillar portion of the steam spray nozzle 169 passing the through hole 124 and the sub-pipe is formed at an inner surface of the inserted portion and an outer surface of the inserting portion, respectively. According to embodiments shown in FIGS. 5 and 6, the screw thread is formed at an outer circumferential surface of the pillar portion of the steam spray nozzle 169 and an inner circumferential surface of the sub-pipe 162. Alternatively, the sub-pipe 162 may be inserted in the steam spray nozzle 169.

Here, a screw thread may be formed at an inner circumferential surface of the through hole 124. If the screw thread is formed at the inner circumferential surface of the through hole 124, the steam spraying unit 160 and the steam spray nozzle 169 may be connected more securely.

The steam spraying unit 160 is separably mounted in a predetermined portion of the mechanism compartment 130.

The steam spraying unit 160 includes a plurality of sub-pipes 162 connected with the plurality of the steam spray nozzles 169, respectively, in communication with each other and a main pipe 164 forming a path, in communication with the sub-pipes 162, to supply steam to the sub-pipes 162.

The main pipe 164 includes a single steam supply hole supplying steam generated at the moisture supply device and a plurality of steam spray holes spraying steam. The steam spray hole is formed at the main pipe 164. The sub-pipe 162 may be an extendedly branched pipe in communication with the steam spray hole.

Since the plurality of the sub-pipes 162 are provided, the steam is received from the steam generator 25 via the single pipe and sprayed via a plurality of spray paths.

This sub-pipe 162 may be branched from the main pipe 164 in plural. A path supplying steam to the sub-pipes 162 is formed in the main pipe 164 and water condensed from the steam may be collected in the inside of the main pipe 164.

In the embodiment shown in FIG. 2, a fluidal direction of the steam supplied to the steam spraying unit 160 is different from a fluidal direction inside the main pipe 164. According to the embodiment of FIG. 2, a steam supply hole 166 is formed at a side surface of the main pipe 164 and the sub-pipe 162 is branched upward. As a result, the fluidal direction of the supplied steam and the fluidal direction of the sprayed steam are cross approximately at right angles.

The water collecting portion is an inner space in which the water condensed from some of the steam during the spraying steam into the accommodating space 110 is collected temporarily. Such the water collecting portion is functioned to contain the condensed water temporarily before evaporating the water into the steam as well as to only contain the condensed water. The water collecting portion may prevent the condensed water from being heated by the steam to be exhausted out of the steam spraying unit 160.

A plurality of projections 165 may be spaced apart a predetermined distance at an outer lower surface of the main pipe 164, such that the steam spraying unit 160 may be separably mounted in the mechanism compartment 130.

In addition, a supporting frame 180 is fixedly installed in the mechanism compartment 140, for example, a bottom of the mechanism compartment 140. The supporting frame 180 is separably secured with the main pipe 164 and it is connected with an upholding portion 184 and a supporting portion 182. Here, the upholding portion 184 upholds the main pipe 164, connected with the supporting portion 182 supporting the main pipe 164. According to the embodiment shown in FIG. 3, the supporting frame 180 is formed in a ⊏ shape, that is, a rectangle with a right open side. However, there is no limit of the shape of the supporting frame 180, if the supporting frame 180 is to install the steam spraying unit 160 in the upper portion of the mechanism compartment 130.

The upholding portion 184 upholds the steam spraying unit 160 and a plurality of grooves 185, corresponding to the plurality of the projections 165, may be formed at the upholding portion 184 such that the steam spraying unit 160 is separably secured to the supporting frame 180.

The supporting portion 182 is fixed to the bottom of the mechanism compartment 130, connected with the upholding portion 184 perpendicularly to support the steam spraying unit 160 in the mechanism compartment 130.

As a result, the steam spraying unit 160 may be supportively installed in the mechanism compartment 130 by the upholding portion 184 and the supporting portion 182.

If the projections of the steam spraying unit 160 is fastened to the grooves 185 formed at the upholding portion 184, the projections 165 passes through the grooves 185 and as a result another fastening means as a bolt may not be provided further.

That is, the steam spraying unit 160, specifically, the main pipe 164 is securely placed on the supporting frame 180 without any other securing means. Thus, the supporting frame 180 may prevent the main pipe 164 from moving in a left and right direction.

The steam spraying unit 160 is mounted on the supporting frame 180 fixed in the mechanism compartment 130 and the steam spraying unit 160 may be installed at a predetermined portion of the mechanism compartment 130, specifically, the connected portion between the spray steam nozzle 169 and the mechanism compartment 130 in which the steam spray nozzle 169 passes the through hole 124 to be connected with the sub-pipe 162. Here, the steam spraying unit 160 may be movable upward and downward, with being put on the supporting frame 180.

Because of the installation structure of the steam spraying unit 160, when a worker passes the steam spray nozzle 169 from the bottom of the accommodating space 110 into the inside of the mechanism compartment 130 in an assembly line, the steam spray nozzle 169 of the steam spraying unit 160 passes the through hole 124 to be connected with the sub pipe 162 correspondingly. The worker does not have to adjust the portion of the steam spraying unit 160 and the steam spray nozzle 169 during the assembly work.

In addition, the steam spray nozzle 169 and the sub-pipe 162 provided in the steam spraying unit may be connected with each other in a screw type.

Since the steam spraying unit 160 is not fixed in a upward and downward direction, with being put on the supporting frame 180, the worker may not adjust the portions of the steam spray nozzle 169 and the steam spraying unit 160 and it is easy for the workers to assemble both of the steam spray nozzle 169 and the steam spraying unit 160.

The sub-pipes 162 provided at the steam spray nozzle 169 and the steam spraying unit 160 may be secured with the steam spray nozzle 169 and the steam spraying unit 160 by a screw.

As mentioned above, the steam spraying unit 160 is not fixed in an upward and downward direction, with being put on the supporting frame 180. As a result, if screw threads are formed at the outer surface of the steam spray nozzle 169 and the inner surface of the sub-pipe 162, respectively.

If the worker finishes to fasten the steam spray nozzle 169 with the sub-pipe 162 the screw by a screw, the steam spraying unit 160 is moved above the supporting frame 180 and the steam spraying unit 160 is mounted at the supporting frame 180, spaced apart a predetermined distance from the supporting frame 180 as shown in FIG. 6.

As shown in FIG. 2, to exhaust outside the condensed water collected in the water collecting portion inside the main pipe 164, a condensed water exhaustion hole 167 is provided at the main pipe 164. The condensed water exhaustion hole 167 is connected with a water collection part 170 provided in the mechanism compartment 130 such that the condensed water is collected in the water collection part 170.

The water condensed in the main pipe 162 may flow toward the condensed water exhaustion hole 167 if the condensed water exhaustion hole 167 is open. As a result, it is known in the embodiment of FIG. 2 that the flow direction of the condensed water is different from the spray direction of the steam.

Here, the main pipe 164 may be preset to have a predetermined oblique such that the condensed water exhaustion hole 167 is positioned in a lower portion of the main pipe 164.

If the water collection part 170 is connected with a drainage system, the water may be discharged to the drainage system directly. If an auxiliary separable water drain part (not shown) is provided, the condensed water is collected in the water collection part temporarily and the water is drained to the drain box. Hence, the drain box is separated to drain the water. The water collection part may contain remaining water inside the moisture supply device or the condensed water inside the steam spraying unit 160. Here, the detailed description of the drainage will be omitted.

In addition, a steam supply hole 166 is provided at the main pipe 164 to supply steam generated at the moisture supply device 150 provided in the mechanism compartment 130. The steam supply hole is connected with a steam hose 155 connected with the moisture supply device.

The steam supply hole 166 supplying the steam generated at the moisture supply device 150 is formed at a side surface of the steam spraying unit 160 and the sub-pipe 162 spraying steam to be supplied to the accommodating space 110 is formed at an upper surface of steam spraying unit 160.

Such the structure makes it possible to spray steam approximately in a perpendicular direction after being supplied approximately in a horizontal direction. As a result, a condensed water exhaustion which might occur during the steam spraying may be reduced, by extension, minimized by the above approximately perpendicularly bent structure.

If the steam supply direction is identical to the steam spray direction, the condensed water might be exhausted together with the steam spraying. This bent structure of the steam supplying and steam spraying prevents the condensed water from being exhausted to the accommodating space.

As shown in FIG. 2, the steam spraying unit 160 includes a the main pipe 164 of a pipe shape and steam supply hole 166 farmed at either of both side surfaces of the main pipe 164 in a length direction.

The sub pipe 162 may be provided in a pipe shape branched from an upper surface of the main pipe, in plural.

In the embodiment of FIG. 2, the main pipe 164 of the steam spraying unit 160 may be provided approximately horizontally. At this time, if the main pipe 164 has an oblique, following advantages may be accomplished.

That is, if the condensed water exhaustion hole 167 which will be described later is provided underneath the oblique, the condensed water may be exhausted smoothly. If the main pipe 164 is inclined down toward the steam supply hole 166 without the condensed water exhaustion hole 167, the condensed water is drained toward the steam supply hole 166 as soon as being generated such that the condensed water may flow to the moisture supply device. Since the condensed water is not polluted water, the high temperature condensed water may be re-used.

As shown in FIG. 7, it is preferable that the mechanism compartment 130 is separable in a forward and backward direction of the cabinet to enhance work efficiency when a worker repairs or replaces the components provided in the mechanism compartment 130.

An opening is formed at a top of the mechanism compartment 130 to be selectively open to the cabinet and various components may be installed on a bottom 192 of the mechanism compartment 130. Here, a wheel 194 may be installed at the bottom 192 such that the bottom 192 may be movable in a forward and backward direction of the mechanism compartment 130.

In addition, a guide groove 196 is formed at an inner surface of the mechanism compartment 130 to guide the bottom 192 to introduce a movable body into the mechanism compartment in the forward and backward direction of the cabinet 100.

Next, an assembly process of the steam spraying unit provided in the clothes-treating apparatus will be described in reference to FIG. 2 to FIG. 5.

First, a worker mounts the steam spraying unit 160 on the supporting frame 180 fixed in the mechanism compartment 130.

Specifically, the projection 165 firmed at the lower surface of the main pipe 164 passes the groove 185 formed at the supporting frame 180, such that the steam spraying unit 160 is secured to the supporting frame 180, being upheld by the supporting frame 180. At this time, the steam spraying unit 160 and the supporting frame 180 are secured, upheld above the supporting frame 180. As a result, the steam spraying unit 160 is movable upward and downward from the supporting frame, with the projection 165 passing the grove 185.

Hence, the steam supply hole 166 provided at the main pipe 164 is connected with the steam hose 155 connected with the moisture supply device 150, to supply steam to the inside of the main pipe 164. Then, a drain hose 172 connected with the water collection part 170 is connected with the condensed water exhaustion hole 167 provided at the main pipe 164 such that the water condensed in the main pipe 164 is drained to the water collection part 170.

Accordingly, the steam spraying unit 160 is mounted in the mechanism compartment 130, movable upward and downward. The sub-pipe 162 is installed at the position corresponding to the through hole 169 formed at the bottom of the accommodating space 110, that is, the partition 120.

Next, if the worker passes the steam spray nozzle 169 through the through-hole 169 formed at the partition 120 from the accommodating space 110, the steam spray nozzle 169 is connected with the sub-pipe 162, corresponding to each other. After that, the steam spray nozzle 169 and the sub-pipe 162 are insertedly rotated and fastened by a screw or the like. As a result, the steam spray nozzle 169 and the sub-pipe 162 are secured to each other.

Hence, if the steam spray nozzle 169 is rotated, the steam spraying unit 160 is moved to the upper surface of the supporting frame 180 and the steam spray nozzle 169 is connected with the steam spraying unit 160. Once the connection between the steam spray nozzle 169 and the sub-pipe 162 is complete, the steam spraying unit 160 is mounted to the supporting frame 180, spied apart a predetermined distance from the supporting frame 180.

Thus, if the steam spray nozzle 169 is connected with the steam spraying unit 160 as mentioned above, the worker does not have to adjust the portion of the steam spray nozzle 169 and the steam spraying unit 160 partitioned by the partition 120 and as a result the worker may assemble the steam spraying unit in the accommodating space efficiently.

In addition, if the mechanism compartment is a movable body, the sub-pipe 162 is installed inside the mechanism compartment 130. Thus, when the mechanism compartment 130 is moved in a forward and backward of the cabinet 100, the sub-pipe 162 is not in contact with the bottom null that the mechanism compartment 130 may be movable smoothly.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A clothes treating apparatus comprising:

a cabinet having a mechanism compartment and an accommodating space where clothes are placed;

a moisture supply device generating steam to be supplied to the accommodating space;

a steam spraying unit mounted in the mechanism compartment, the steam spraying unit having a main pipe having a steam supply hole and a plurality of sub-pipes extended from the main pipe;

a partition partitioning off an interior space of the cabinet into the mechanism compartment and the accommodating space, the partition having a plurality of through holes; and a plurality of steam spray nozzles fastened to the sub-pipes and supplying steam to the accommodating space, wherein the steam spraying unit is mounted to a supporting frame provided in a mechanism compartment to support the steam spraying unit, wherein a plurality of projections are formed at a lower surface of the steam spraying unit and a plurality of grooves corresponding to the projections are formed at an upper surface of the supporting frame, and the projection is fixedly inserted in the corresponding groove, wherein the through holes at the partition are aligned and communicated with the sub-pipes of the steam spraying unit, wherein the plurality of steam spray nozzles are connected the corresponding sub-pipes under the partition by passing the steam spray nozzles through the through holes of the partition from an inside of the accommodating space, and wherein if the projections are inserted in the grooves, the height of the steam spraying unit is substantially lower than the height of the steam spraying unit when the plurality of steam spray nozzles are fastened to the plurality of sub-pipes.

2. The clothes treating apparatus of claim 1, wherein a flow direction of the steam inside the main pipe is different from a flow direction of the steam inside the sub-pipe.

3. The clothes treating apparatus of claim 2, wherein the flow direction of the steam inside the main pipe is orthogonal to the flow direction of the steam inside the sub-pipe.

4. The clothes treating apparatus of claim 3, wherein the steam is supplied by the main pipe in a horizontal direction and the steam is sprayed in an upward direction by the sub-pipe.

5. The clothes treating apparatus of claim 1, wherein a flow direction of the steam sprayed from the steam spraying unit is different from a flow direction of water condensed inside the steam spraying unit.

6. The clothes treating apparatus of claim 1, wherein water condensed from the steam inside the main pipe is collected in a lower portion of the main pipe and the steam supplied by the steam supply hole is flowing in an upper portion of the main pipe.

7. The clothes treating apparatus of claim 6, wherein the condensed water collected in the main pipe is drained through a condensed water exhaustion hole formed at the main pipe.

8. The clothes treating apparatus of claim 7, wherein the main pipe is inclined for the condensed water exhaustion hole to face downward.

9. The clothes treating apparatus of claim 8, wherein the condensed water exhausted via the condensed water exhaustion hole is drained to a water collection part containing water temporarily before being drained outside.

10. The clothes treating apparatus of claim 1, wherein the steam spray nozzle comprises a plurality of spray holes.

11. The clothes treating apparatus of claim 10, wherein an upper surface of the steam spray nozzle has a convex curvature.

12. The clothes treating apparatus of claim 1, wherein either of the sub-pipe and a predetermined portion of the steam spray nozzle is inserted in the other, the predetermined portion being fastened to the sub-pipe through the partition.

13. The clothes treating apparatus of claim 12, wherein a screw thread is formed at an inner surface of the sub-pipe and an outer surface of the portion of the steam spray nozzle fastened to the sub-pipe through the partition, to screw-fasten the steam spray nozzle to the steam spraying unit, with the partition being provided between the steam spray nozzle and the steam spraying unit.

14. The clothes treating apparatus of claim 1, wherein a bottom of the mechanism compartment is separable from the mechanism compartment and if the bottom of the mechanism compartment is separated outside the cabinet, the steam spraying unit is separated outside the cabinet in a state of being mounted to the supporting frame.

15. The clothes treating apparatus of claim 1, further comprising:

an air supply device dehumidifying or heating air inside the accommodating space.

16. The clothes treating apparatus of claim 15, wherein the air supply device comprises a heat pump including a compressor compressing refrigerant, and a heat exchanger heat-exchanging the refrigerant with the air inside the accommodating space.

* * * * *